US007997882B2

(12) United States Patent
Shulver et al.

(10) Patent No.: US 7,997,882 B2
(45) Date of Patent: Aug. 16, 2011

(54) REDUCED ROTOR ASSEMBLY DIAMETER VANE PUMP

(75) Inventors: David R. Shulver, Richmond Hill (CA); Stefan Olaru, Thornhill (CA); Matthew Williamson, Richmond Hill (CA)

(73) Assignee: Magna Powertrain Inc., Concord (CA)

( * ) Notice: Subject to any disclaimer, the term of this patent is extended or adjusted under 35 U.S.C. 154(b) by 394 days.

(21) Appl. No.: 12/281,051

(22) PCT Filed: Mar. 1, 2007

(86) PCT No.: PCT/CA2007/000328

§ 371 (c)(1),
(2), (4) Date: Aug. 28, 2008

(87) PCT Pub. No.: WO2007/098595

PCT Pub. Date: Sep. 7, 2007

(65) Prior Publication Data

US 2009/0053088 A1 Feb. 26, 2009

Related U.S. Application Data

(60) Provisional application No. 60/778,155, filed on Mar. 1, 2006.

(51) Int. Cl.

| | |
|---|---|
| ***F03C 4/00*** | (2006.01) |
| ***F04C 2/00*** | (2006.01) |
| ***F04C 14/18*** | (2006.01) |

(52) U.S. Cl. ..... 418/26; 418/30; 418/152; 418/179

(58) Field of Classification Search ..... 418/24–30, 418/152, 179, 259, 266–268, 81, 82

See application file for complete search history.

(56) References Cited

U.S. PATENT DOCUMENTS

| | | | | |
|---|---|---|---|---|
| 2,628,567 | A * | 2/1953 | De Lancey et al. | 418/26 |
| 2,748,716 | A | 6/1956 | Janik | |
| 4,144,005 | A | 3/1979 | Brucken | |
| 4,437,819 | A * | 3/1984 | Merz | 418/26 |
| 4,558,998 | A | 12/1985 | Kiyoshige et al. | |
| 4,616,984 | A * | 10/1986 | Inagaki et al. | 418/150 |
| 5,918,573 | A * | 7/1999 | Killion | 417/286 |
| 2004/0216956 | A1 * | 11/2004 | Pascoe et al. | 184/27.1 |

* cited by examiner

*Primary Examiner* — Theresa Trieu

(74) *Attorney, Agent, or Firm* — Harness, Dickey & Pierce, P.L.C.

(57) ABSTRACT

A vane pump with a reduced rotor diameter is provided. The reduced rotor diameter allows a reduction in the overall size of the pump which allows the pump to be used in circumstances wherein sufficient packaging volume does not exist for conventional vane pumps. Further, the reduced rotor diameter permits operation of the pump at a higher speed, in comparison to conventional vane pumps, for a given working fluid and pump rate. The rotor includes an integrally formed drive shaft and a cylindrical rotor head. Both fixed displacement and variable displacement embodiments are shown.

12 Claims, 4 Drawing Sheets

REDUCED ROTOR ASSEMBLY DIAMETER VANE PUMP

CROSS-REFERENCE TO RELATED APPLICATIONS

This application is the national phase under 35 U.S.C. §371 of PCT International Application No. PCT/CA2007/000328 which has an international filing date of Mar. 1, 2007, which designated the United States of America and which application claims the benefit of U.S. Provisional Application No. 60/778,155, filed Mar. 1, 2006. The entire disclosures of each of the above applications are incorporated herein by reference.

FIELD OF THE INVENTION

The present invention relates to a vane pump. More specifically, the present invention relates to a vane pump with a reduced rotor assembly diameter.

BACKGROUND OF THE INVENTION

Vane pumps are well known and are used in a wide variety of environments. In the automotive field, vane pumps are used in power steering systems, automatic transmission systems and, somewhat more recently, engine lubrication systems amongst others.

While vane pumps provide a number of features and advantages, they do suffer from a disadvantage in that their rotor design and construction has resulted in a rotor assembly diameter which is larger than might otherwise be desired.

This relatively large rotor assembly diameter has prevented the use of vane pumps when insufficient packaging space (i.e.—installation or mounting volume) is available for the pump. Further, as the operating speed of a vane pump is limited to rotational speeds which keep the tip speed of the vanes below the velocity at which the working fluid will cavitate (causing damage and/or excessive wear), the larger the rotor assembly diameter is the slower the maximum speed at which the pump can be operated.

SUMMARY OF THE INVENTION

It is an object of the present invention to provide a novel vane pump which obviates or mitigates at least one disadvantage of the prior art.

According to a first aspect of the present invention, there is provided a vane pump, comprising: a pump chamber, a rotor assembly rotatably received in the pump chamber, the rotor assembly comprising: a rotor having a circular rotor head with a cylindrical wall extending therefrom and an integrally formed drive shaft extending opposite the cylindrical wall; a set of vanes slidably extending through slots formed in the cylindrical wall of the rotor head; and a vane ring located within the cylindrical wall of the rotor head and engaging a substantial portion of the radially inner tip of each vane to maintain the radially outer tip of each vane in contact with a wall of the pump chamber as the rotor rotates and preventing each vane from tilting out of the plane of rotation of the rotor.

According to another aspect of the present invention, there is provided a variable displacement vane pump, comprising: a pump chamber; a control ring pivotally mounted within the pump chamber; a rotor assembly rotatably received in the pump chamber within the control ring, the rotor assembly comprising: a rotor having a circular rotor head with a cylindrical wall extending therefrom and an integrally formed drive shaft extending opposite the cylindrical wall; a set of vanes slidably extending through slots formed in the cylindrical wall of the rotor head; and a vane ring located within the cylindrical wall of the rotor head to maintain the radially outer tip of each vane in contact with a wall of the control ring as the rotor rotates and to prevent each vane from tilting out of the plane of rotation of the rotor.

According to yet another aspect of the present invention, there is provided a dynamic balancer for an internal combustion engine, comprising: at least one balance shaft driven by the internal combustion engine, each balance shaft including an eccentrically mounted balance weight; and a lubricating oil vane pump, the vane pump comprising: a pump chamber, a rotor assembly rotatably received in the pump chamber and rotated by the dynamic balancer, the rotor assembly comprising: a rotor having a circular rotor head with a cylindrical wall extending therefrom and an integrally formed drive shaft extending opposite the cylindrical wall, the drive shaft rotating with the at least one balance shaft; a set of vanes slidably extending through slots formed in the cylindrical wall of the rotor head; and a vane ring located within the cylindrical wall of the rotor head and engaging a substantial portion of the radially inner tip of each vane to maintain the radially outer tip of each vane in contact with a wall of the pump chamber as the rotor rotates and preventing each vane from tilting out of the plane of rotation of the rotor.

The present invention provides a vane pump with a reduced rotor assembly diameter which reduces the overall radial size of the pump and which permits operation of the pump at a higher speed, in comparison to conventional vane pumps, for a given working fluid and pump rate. The rotor includes an integrally formed drive shaft and a cylindrical rotor head. The vane pump of the present invention is believed to be particularly suited to use as an engine lubricating oil pump in a dynamic balancer for an internal combustion engine wherein available packaging volumes are relatively small and wherein the operating speed of the pump can be relatively high but can also be used in a variety of other applications including automatic transmissions and non-automotive systems.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

As used herein, the terms "rotor assembly diameter" and the like are intended to comprise a measure of the maximum extent to which the radially outer tip of a vane extends from the center of revolution of the rotor, as the rotor assembly makes a revolution.

Figure 1:
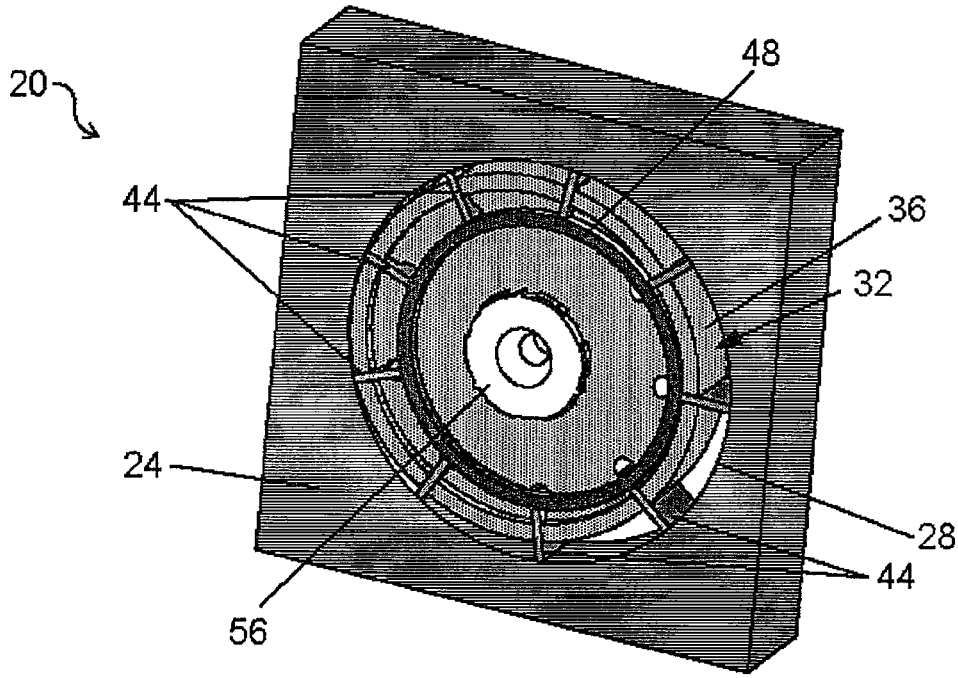
Fig. 1 (prior art)
FIG. 1 shows a perspective view of the front and side of a rotor assembly and rotor housing of a prior art vane pump.
Figure 2:
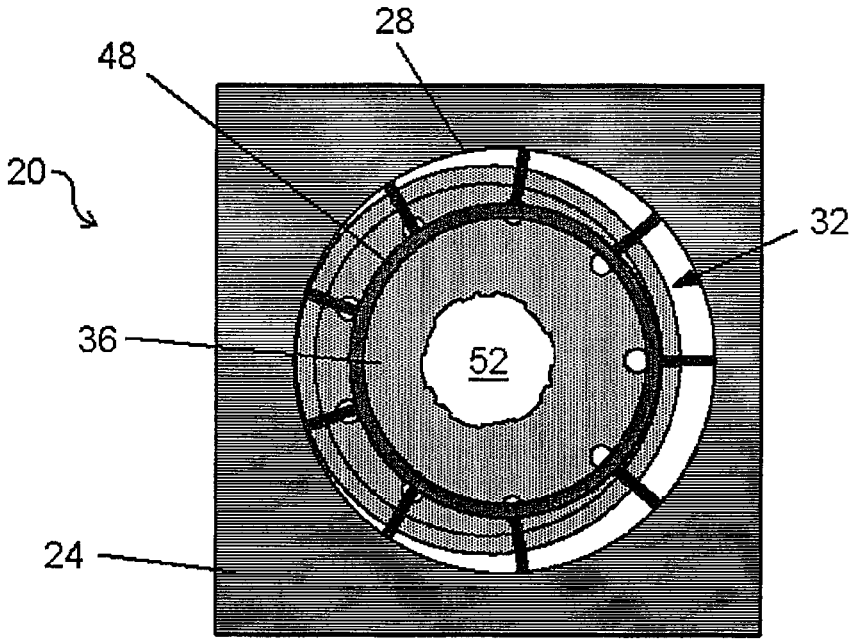
Fig. 2 (prior art)
FIG. 2 shows a front view of the rotor assembly and rotor housing of FIG. 1.

A prior art vane pump is indicated generally at 20 in FIGS. 1 and 2. As illustrated, pump 20 includes a rotor housing 24 which defines a pump chamber 28 in which a rotor assembly 32 is located.

Rotor assembly 32 includes a rotor 36 with a set of radially extending slots formed therein in which a set of pump vanes 44 are slidably retained. A vane ring 48 abuts the inner ends of vanes 44 and ensures that the outer ends of vanes 44 remain in engagement with the wall of pump chamber 28 as rotor 36 rotates. Rotor 36 further includes an indexed center bore 52 in which a drive shaft 56 is received such that rotation of drive shaft 56 rotates rotor 36.

As will be apparent, the smallest possible diameter of rotor 36 is a function of the size of drive shaft 56. Depending upon the expected load to be carried by drive shaft 56, it must be of a given size. Similarly, to transfer that load to vanes 44, rotor 36 must include sufficient material to safely carry the load from shaft 56 and thus the radial slots in which vanes 44 are mounted can only extend inwardly towards bore 52 to a partial extent, thus limiting the smallest diameter with which rotor 36 can be constructed.

Figure 3:
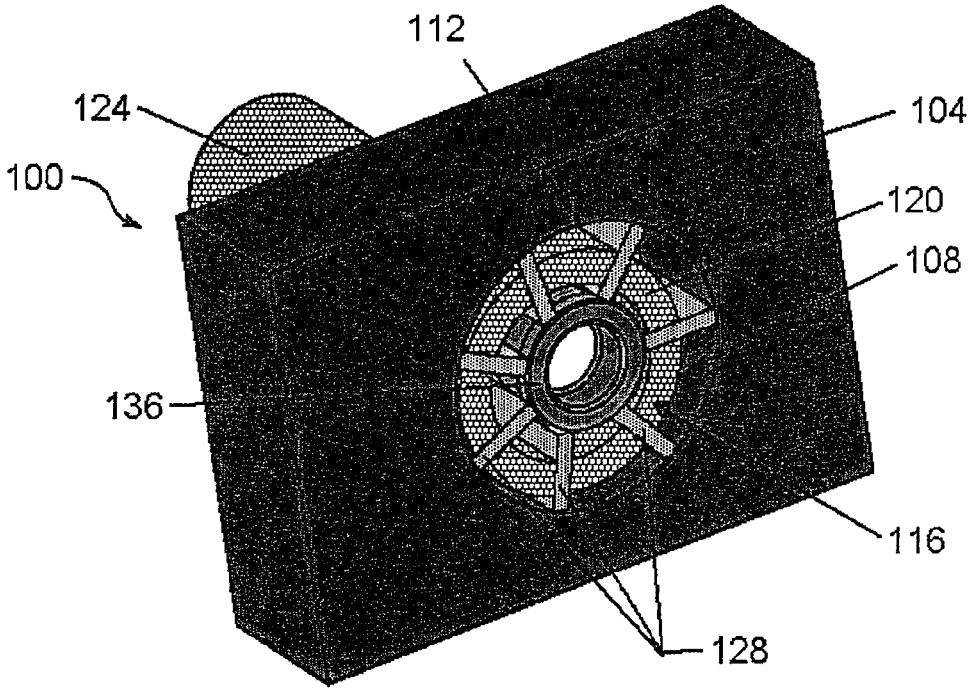
FIG. 3 a perspective view of the front and side of a rotor assembly and rotor housing of a vane pump in accordance with the present invention.
Figure 4:
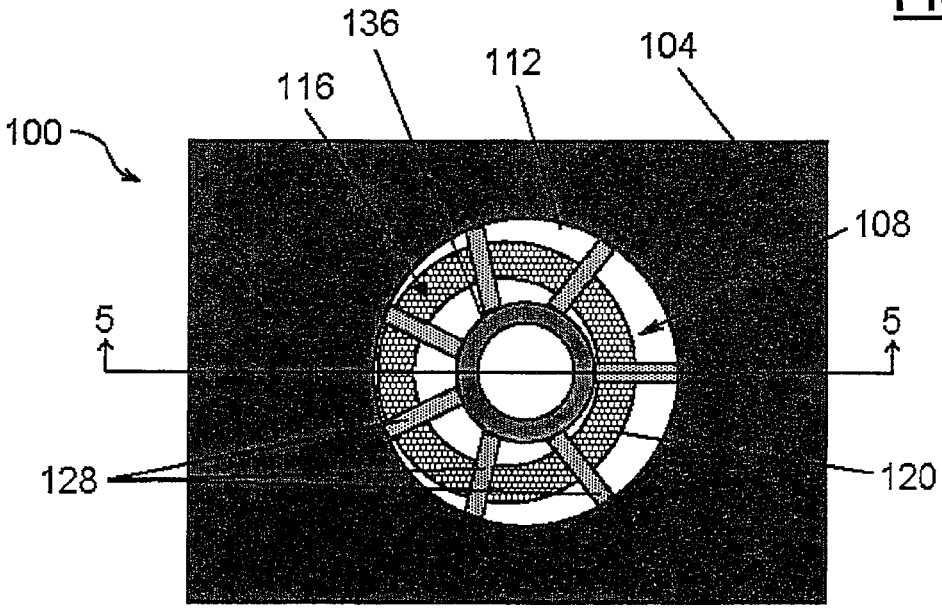
FIG. 4 shows a front view of the vane pump of FIG. 3.

A vane pump in accordance with the present invention is indicated generally at 100 in FIGS. 3 and 4. As shown, pump 100 comprises a rotor housing 104 and a rotor assembly 108.

Rotor housing 104 defines a pump chamber 112 in which rotor assembly 108 is received. Pump chamber 112 has a circular cross section having an axis of rotation.

While not shown but is well known in the art of vane pumps, rotor housing 104 also includes a pump inlet in fluid communication with a low pressure region in pump chamber 112 and which allows low pressure working fluid to be introduced into pump chamber 112 and rotor assembly 108 and to be pressurized thereby. Additionally, rotor housing 104 includes a pump outlet (also not shown) in fluid communication with a high pressure region in pump chamber 112 and which allows working fluid pressurized by pump 100 to exit pump chamber 112.

Figure 5:
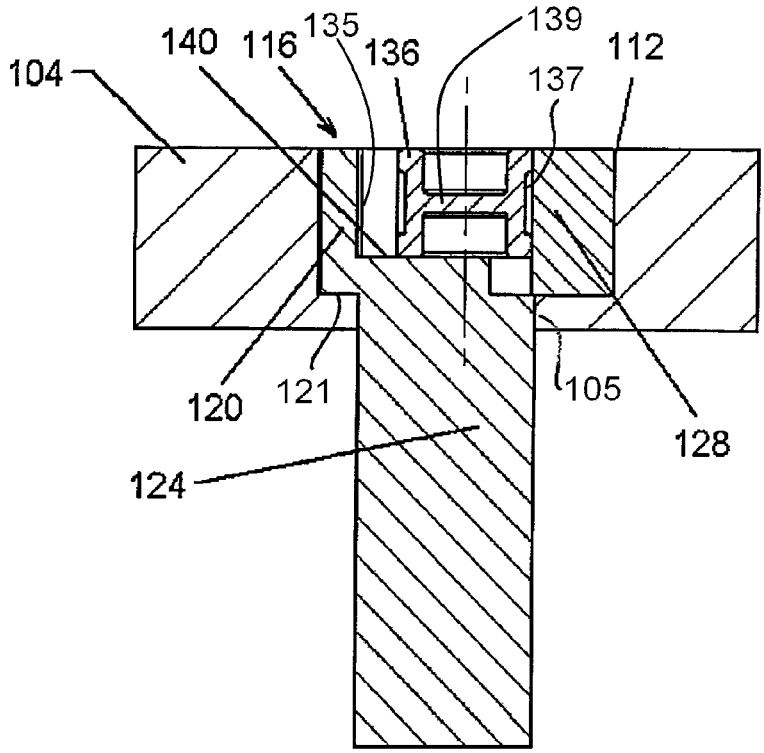
FIG. 5 shows a section taken along line 5-5 of FIG. 4.
Figure 6:
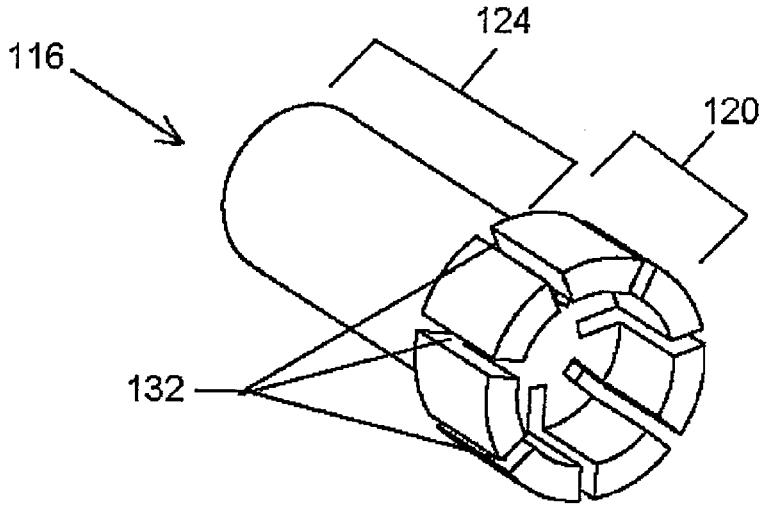
FIG. 6 shows a perspective view of a rotor for the pump of FIG. 4.

As best seen in FIGS. 5 and 6, rotor assembly 108 comprises a novel rotor 116 which includes a rotor head 120 and an integrally formed drive shaft 124. Rotor head 120 is generally of the form of a hollow cylinder, having a diameter that is larger than the drive shaft 124. The rotor head 120 includes a set of circumferentially spaced radial slots 132 extending through the wall of the cylinder. Rotor head 120 extends through an circular opening 105 in the housing 104 in relatively close tolerance. The shoulder surface 121 of the rotor head 120 slidingly engages the floor of pump chamber 112. The close tolerance fit substantially seals the interface between the drive shaft 124 and the housing.

As best seen in FIGS. 3 and 4, a set of radially extending vanes 128 are slidably received in slots 132. A vane ring 136 abuts the radially inner ends of vanes 128 to maintain the radially outer ends of vanes 128 in sealing contact with the inner surface of pump chamber 112 as rotor 116 rotates. Since the axis of rotation of the rotor 116 is offset from the axis of rotation of the pump chamber 112, adjacent vanes 128 sealingly cooperate with the rotor head 120 and the inner surface of pump chamber 112 to define a series of pumping chambers that volumetrically expand and contract as the rotor 116 rotates. The pump inlet is in fluid communication with the pumping chambers that are expanding and the pump outlet is in fluid communication with the pumping chambers that are contracting.

The embodiment of rotor 116 illustrated in FIGS. 3 through 6 is fabricated from molded powdered metal in any suitable manner, as will be understood by those of skill in the art. However, it is also contemplated that a suitable rotor for the present invention can be formed in a variety of other manners including, without limitation, by machining from steel or other suitable materials, as will occur to those of skill in the art.

Figure 7:
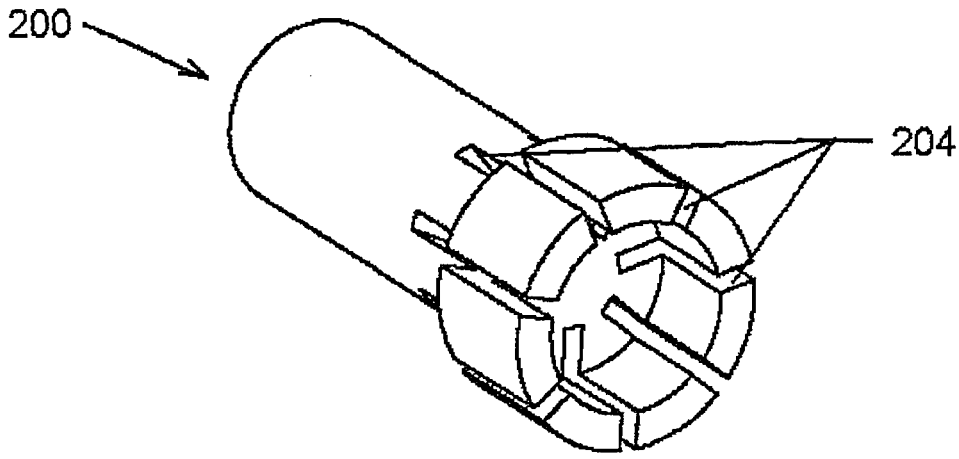
FIG. 7 shows a perspective view of another rotor for the pump of FIG. 4.

An example of another suitable rotor is shown in FIG. 7. In FIG. 7, rotor 200 has been machined from a suitable steel material. As shown, the slots 204 for vanes 128 extend somewhat into the integrally formed drive shaft as a result of the slot machining operation. It is further contemplated that suitable rotors for pump 100 can be fabricated from a variety of other materials, including plastic materials such as PEEK (polyether-ether-keytone), depending upon the working fluid, etc. as will be apparent to those of skill in the art.

In conventional vane pumps, such as that illustrated in FIGS. 1 and 2, a vane ring must be employed on both the top and bottom of the rotor to prevent the vanes from twisting out of the rotational plane of the rotor and binding in their respective slots.

In contrast, in rotor assembly 108, a single vane ring 136 is employed. Vane ring 136 is generally cylindrical and preferably, the circumferential face of the vane ring 136 has an annular groove 137 extending thereabout. The vane ring may also include a hub 139. Vane ring 136 is positioned within a recess 135 that extends a distance greater than one-half a thickness of rotor head 120. Vane ring 136 is sized to extend from the floor 140 of the interior of rotor head 120, axially extending substantially the entire depth of recess 135, and sit substantially flush with the top of rotor head 120. In this position, vane ring 136 engages approximately two thirds of the inner edge of each vane 128 to prevent vanes 128 from twisting out of the plane of rotation of rotor head 120.

Vane ring 136 can be a hollow cylindrical member, a solid cylindrical member or any other suitable shape, as will occur to those of skill in the art. It is further contemplated that the construction of vane ring 136 is not particularly limited and vane ring 136 can be machined from steel or other suitable material, molded from powered metal or a suitable engineering plastic, etc. It is also contemplated that vane ring 136 can be a composite of two or more cylindrical members, stacked within rotor head 120.

As should now be apparent, by integrally forming rotor head 120 and drive shaft 124, the diameter of rotor head 120 can be reduced when compared to that of conventional vane pump rotors, such as that illustrated in FIGS. 1 and 2. By reducing the diameter of rotor head 120, the maximum radial length of the tip of a vane 128 from the center of rotation of rotor 116 is significantly less than in conventional vane pumps, reducing the rotor assembly diameter and allowing pump 100 to operate at higher speeds than the conventional vane pump.

Further, as rotor head 120 can have a smaller diameter than the rotor of a conventional vane pump, vane pump 100 can be used in environments where insufficient packaging volume exists for conventional vane pumps.

Figure 8:
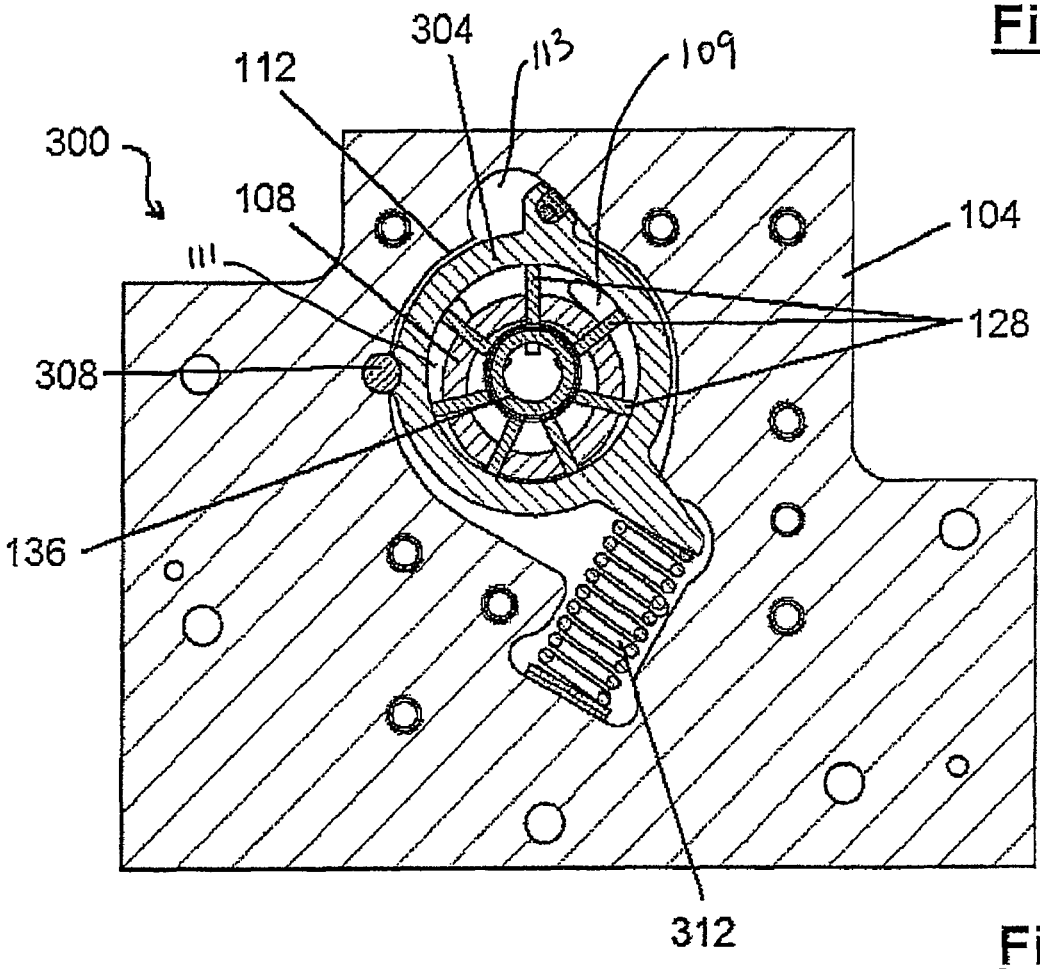
FIG. 8 shows a front view of a variable displacement vane pump in accordance with the present invention.

FIG. 8 shows another embodiment of the present invention wherein like components to those of FIGS. 3, 4, 5, 6 and 7 are indicated with like reference numbers. In FIG. 8, a variable displacement vane pump in accordance with the present invention is indicated generally at 300. Pump 300 includes a rotor housing 104 which defines a pump chamber 112. Pump chamber 112 has an inlet 109 and an outlet 111. A control ring 304 encircles rotor assembly 108.

The radially outer tips of vanes 128 contact the inner surface of control ring 304 which pivots about a pivot point 308 to alter the eccentricity of rotor assembly 108 and pump chamber 112 to alter the volumetric displacement of pump 300. A biasing spring 312 biases control ring 304 to the maximum displacement position. A passageway (not illustrated) extends from the outlet 111 to a control chamber 113 so that as the pressure in the pumping chambers increases, the pressure in control chamber 113 increases resulting in a force that acts against the biasing force of the spring 312, reducing the volume of flow through the pump 300.

Pump 300 provides the same reduced package size and higher operating speed advantages as pump 100 and allows the displacement of pump 300 to be altered as desired.

One particular use contemplated by the present inventors for vane pumps in accordance with the present invention is use in dynamic balancers, which are employed in many internal combustion engines to reduce engine vibrations. Such dynamic balancers are typically mounted in the sump of the engine and include one or more balance shafts which rotate eccentric weights to reduce the engine vibration. The location of these dynamic balancers in the sump of the internal combustion engine results in very constrained packaging volumes and it would be difficult, if not impossible to mount a conventional vane pump in the available space.

Further, even if one were to successfully mount a conventional vane pump in a dynamic balancer, such balancers often operate at twice the speed of the crankshaft of the engine and thus, in many circumstances, the operating speed of the dynamic balancer would be above that at which a conventional vane pump would experience cavitation and/or excessive vane wear.

In contrast, a vane pump 100 in accordance with the present invention can require smaller packaging volumes than conventional vane pumps and can be installed with drive shaft 124 being connected to, or comprising part of, a balance shaft in the balancer, as described in US Patent application no. US 2004/0216956 A1. Further, due to the reduced rotor assembly diameter of vane pump 100, vane pump 100 can be operated at the higher rotational speeds of the dynamic balancer with a greater operating speed margin from the operating speed at which cavitation would occur.

The present invention provides a vane pump with a reduced rotor assembly diameter. By reducing the rotor assembly diameter the overall size of the pump can be reduced which allows the pump to be employed in circumstances which do not have sufficient available packaging volume for conventional pumps. Further, the smaller rotor assembly diameter of the present invention permits operation of the inventive pump at a higher speed, in comparison to conventional vane pumps, for a given working fluid and pump rate.

The above-described embodiments of the invention are intended to be examples of the present invention and alterations and modifications may be effected thereto, by those of skill in the art, without departing from the scope of the invention which is defined solely by the claims appended hereto.

We claim:

1. A vane pump, comprising:

a pump chamber having an inlet and an outlet, a rotor assembly rotatably received in the pump chamber, the rotor assembly comprising:

a rotor having a circular rotor head with a cylindrical wall extending therefrom and an integrally formed drive shaft extending opposite the cylindrical wall;

a set of vanes slidably extending through slots formed in the cylindrical wall of the rotor head; and a vane ring located within the cylindrical wall of the rotor head to maintain the radially outer tip of each vane in contact with a wall of the pump chamber, the vane ring axially extending a distance substantially two-thirds the length of each vane, the set of vanes in sealing cooperation with the rotor head and the pump chamber to define a series of expanding and contracting pumping chambers as the rotor rotates, said expanding pumping chambers in fluid communication with said inlet and said contracting pumping chambers in fluid communication with said outlet.

2. A vane pump according to claim 1 wherein the rotor is manufactured from powdered metal.

3. A vane pump according to claim 1 wherein the rotor is manufactured from metal.

4. A vane pump according to claim 1 wherein the rotor is manufactured from plastic.

5. The vane pump according to claim 1 wherein the vane ring is a cylindrical body.

6. The vane pump according to claim 1 wherein the vane ring is hollow.

7. The vane pump according to claim 1 wherein the vane ring is manufactured from metal.

8. The vane pump according to claim 1 wherein the vane ring is manufactured from plastic.

9. The vane pump according to claim 1 wherein the vane ring comprises two vane ring members stacked within the cylindrical wall of the rotor head.

10. A vane pump, comprising:

a pump chamber having an inlet and an outlet, a rotor assembly rotatably received in the pump chamber, the rotor assembly comprising:

a rotor having a circular rotor head with a cylindrical wall extending therefrom and an integrally formed drive shaft extending opposite the cylindrical wall;

a set of vanes slidably extending through slots formed in the cylindrical wall of the rotor head; and a vane ring located within the cylindrical wall of the rotor head to maintain the radially outer tip of each vane in contact with a wall of the pump chamber, the set of vanes in sealing cooperation with the rotor head and the pump chamber to define a series of expanding and contracting pumping chambers as the rotor rotates, said expanding pumping chambers in fluid communication with said inlet and said contracting pumping chambers in fluid communication with said outlet, wherein said vane ring has an annular groove in a circumferential surface, said circumferential surface engaging said set of vanes.

11. A variable displacement vane pump, comprising:

a pump chamber having an inlet and an outlet;

a control ring pivotally mounted within the pump chamber and biased to a maximum displacement position;

a rotor assembly rotatably received in the pump chamber within the control ring, the rotor assembly comprising:

a rotor having a circular rotor head with a cylindrical wall extending therefrom and defining a recess extending a distance greater than one-half a thickness of the rotor head, the rotor including an integrally formed drive shaft extending opposite the cylindrical wall;

a set of vanes slidably extending through slots formed in the cylindrical wall of the rotor head; and a vane ring located within the recess and axially extending substantially its entire depth to maintain the radially outer tip of each vane in contact with a wall of the control ring, the set of vanes in sealing cooperation with the rotor head and the pump chamber to define a series of expanding and contracting pumping chambers as the rotor rotates, said expanding pumping chambers in fluid communication with said inlet and said contracting pumping chambers in fluid communication with said outlet.

12. The vane pump according to claim 11 wherein said vane ring has an annular groove in a circumferential surface, said circumferential surface engaging said set of vanes.

* * * * *